United States Patent [19]

Cagle

[11] 4,149,671

[45] Apr. 17, 1979

[54] SOLID FUEL FURNACE

[76] Inventor: Bunyan B. Cagle, 1700 Towson Ave., Fort Smith, Ark. 72901

[21] Appl. No.: 813,962

[22] Filed: Jul. 8, 1977

[51] Int. Cl.[2] ..... F23N 1/02

[52] U.S. Cl. ..... 236/11; 126/110 R; 126/112

[58] Field of Search ..... 236/11; 126/110 R, 110 B, 126/116 R, 112

[56] References Cited

U.S. PATENT DOCUMENTS

| | | | |
|---|---|---|---|
| 1,813,732 | 7/1931 | Freeman | 236/11 |
| 2,210,768 | 8/1940 | McNamar | 126/116 R |
| 2,431,772 | 12/1947 | Russell | 126/110 R |
| 2,456,570 | 12/1948 | Stuckey et al. | 126/77 X |
| 3,171,399 | 3/1965 | Kirgan | 126/110 B |
| 3,981,291 | 9/1976 | Smith | 126/110 R |
| 4,020,822 | 5/1977 | Harris | 126/110 R |
| 4,047,515 | 9/1977 | Daniel | 126/110 R |

*Primary Examiner*—William E. Wayner
*Assistant Examiner*—William E. Tapolcai, Jr.
*Attorney, Agent, or Firm*—O'Brien and Marks

[57] ABSTRACT

A solid fuel furnace is disclosed as including a firebox disposed inside of a heating chamber through which air to be heated is passed. A pair of baffles guides the air through the heating chamber to progressively heat the air. In addition, an auxiliary air system is provided to inject air into the fire when there is a heating demand to increase combustion and provide more heat when it is most needed.

5 Claims, 4 Drawing Figures

SOLID FUEL FURNACE

BACKGROUND OF THE INVENTION

1. Field of the Invention

The present invention relates to furnaces in general and in particular to solid-fuel furances of the type having an air jacket around the firebox to pass heated air through.

2. Description of the Prior Art

The prior art is generally cognizant of solid fuel heaters in which air is forced around or through the actual fire chamber by an electric blower. U.S. Pat., Nos. 1,490,135 and 3,219,024 are examples of heaters including such blowers. The prior art is also cognizant of solid fuel heaters having special air tubing to admit air to the combustion area, as shown by U.S. Pat. Nos. 1,596,922 and 2,456,570 other examples of furnaces having fire chambers around which air is directed are U.S. Pat. No. 419,122, No. 1,034,799, No. 1,697,225 and No. 2,513,443.

SUMMARY OF THE INVENTION

The present invention is summarized in that a solid fuel furnace includes a firebox for containing the fire, a heating chamber surrounding the firebox, a thermally responsive fan switch located in the furnace, a circulating air fan controlled by the fan switch to force air through the heating chamber and around the firebox to supply heated air, a combustion air manifold inside the firebox, a room thermostat located in a room, and a combustion air blower controlled by the thermostat and connected to the combustion air manifold to inject air into the fire to increase the rate of combustion of the fire when there is a heating demand.

It is an object of the present invention to construct a solid fuel furnace which conserves fuel by causing a rapid rate of combustion only when there is a heating demand.

It is another object of the present invention to heat air by channeling it around the firebox of a solid fuel furnace in a most efficient and economical manner.

It is yet another object of the present invention to construct a solid fuel furnace in which the heated air leaving the furnace is at a maximally high temperature.

Other objects, advantages and features of the present invention will become apparent from the following description when taken in conjunction with the accompanying drawings.

DESCRIPTION OF THE PREFERRED EMBODIMENT

Figure 1:
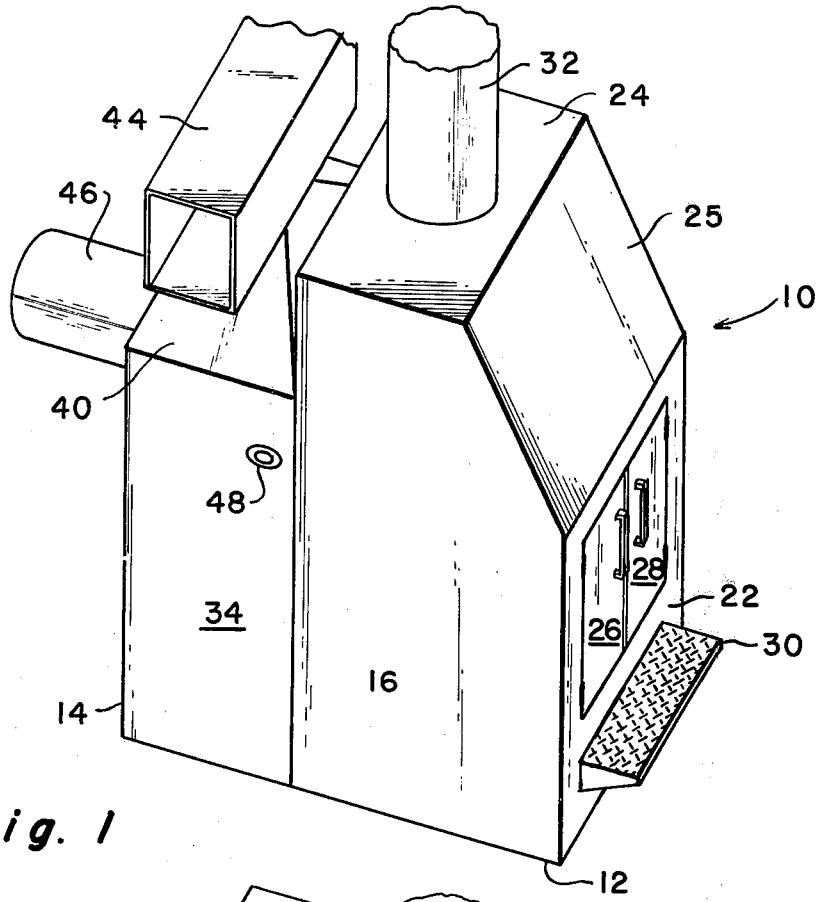
FIG. 1 is a perspective view of a solid fuel furnace constructed according to the present invention.

As is shown in FIG. 1, the present invention is embodied in a solid fuel furnace, indicated generally at 10, constructed according to the present invention. The furnace 10, which is preferably fabricated from welded sheet steel, includes, as viewed from the exterior in FIG. 1, a heating chamber 12 and an auxiliary chamber 14 attached behind it. The heating chamber 12 exterior is composed of a pair of heating jacket side walls 16 (only one shown) joined by a furnace base 20, a front wall 22, an outer top wall 24, and an outer canted wall 25 joining the outer top wall 24 to the front wall 22. A pair of hinged doors 26 and 28 are provided in the front wall 22 and a ledge piece 30 with a textured top surface is provided as a shelf just below the doors 26 and 28 on the front wall 22. A flue stack 32 is provided extending upward from the outer top wall 24.

The auxiliary chamber 14 includes a pair of auxiliary chamber side walls 34 (only one shown), which are connected by the furnace base 20, a rear wall 38, a pyramidal-shaped air intake chamber 40, and a firewall 42 which forms the front wall of the auxiliary chamber 14 as well as the rear wall of the heating chamber 12. An air intake duct 44 is provided connected to the air intake chamber 40 on the top of the auxiliary chamber 14. A heated air duct 46 extends rearwardly from the rear wall 38 of the furnace 10. A combustion air intake port 48 is provided in the auxiliary chamber side wall 34.

Figure 2:
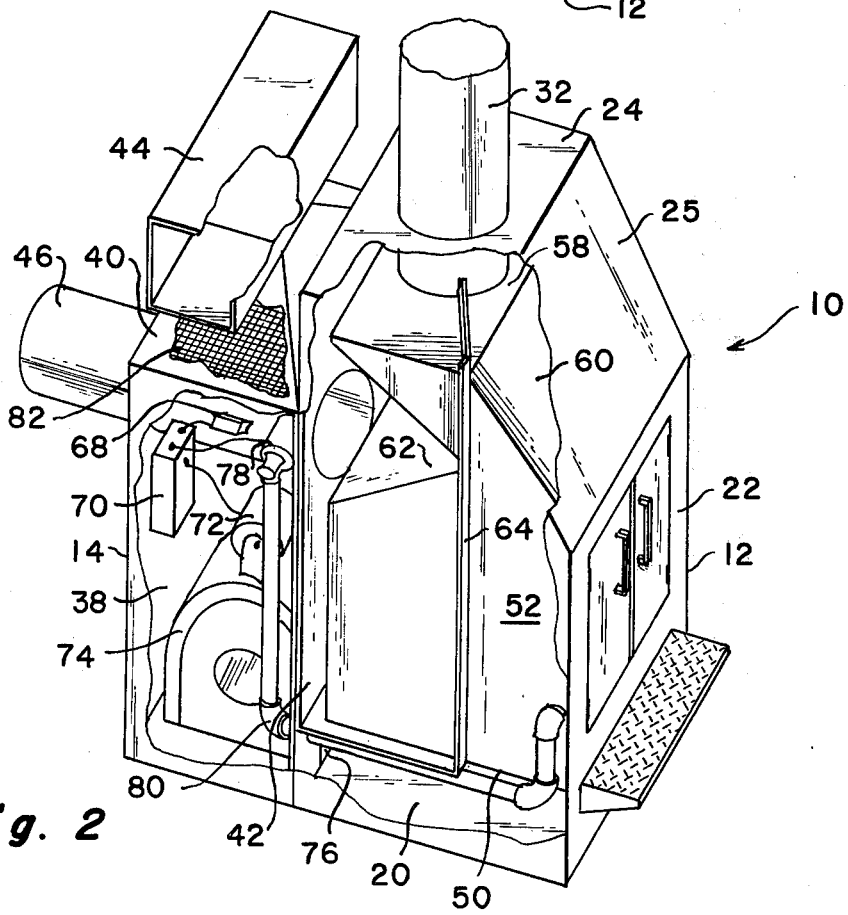
FIG. 2 is a perspective view similar to the furnace of FIG. 1 with a portion of the side wall cut away.

As can be seen from the cut-away view of the furnace 10 in FIG. 2 in which most of the heating jacket side wall 16 and auxiliary chamber side wall 34 have been removed, inside of the heating chamber 12 there is formed a firebox 50. The firebox 50 is formed by a pair of firebox side walls 52 (only one shown) connected by a firebox base 56, a firebox rear wall (not shown), the front wall 22, an inner top wall 58 and an inner canted wall 60 joining the inner top wall 58 to the front wall 22. A smoke shelf 62 is formed as a ledge or indentation in the firebox rear wall 57 and it extends forwardly forming a narrowed region of the firebox 50 between the smoke shelf 62 and the inner canted wall 60. The flue stack 32 extends intact through the outer top wall 24 to join the inner top wall 58 and open into the interior of the firebox 50. A pair of identical baffles 64 (only one shown) formed on each side of the firebox 50 extending between the firebox side walls 52 and 54 and the heating jacket side walls 16 and 18 with only the baffle 64 being seen in FIG. 2. The lower section of the baffle 64 extends horizontally forward from the firewall 42 along the bottom of the firebox 50. Approximately midway across the firebox side wall 52 the baffle 64 turns vertically upward extending to the top of the firebox side wall 52. A top section of the baffle 64 extends across the top of the inner top wall 58 to the flue stack 32. A portion of each of the baffles 64 extends inwardly between the firebox rear wall (not shown) and the firewall 42 so that the baffles 64 are joined behind the firebox 50. All along its lower sections the baffle 64 extends completely between the respective surface of the firebox 50 and the heating chamber 12 but the spacing between the inner and outer top walls 58 and 24 is such that an air gap is left between the top section of the baffle 64 and the outer top wall 24.

The details of the interior of the auxiliary chamber 14 can be seen in FIG. 2. The heated air duct 46 extends intact through the auxiliary chamber 14 and opens through the firewall 42 into the interior of the heating chamber 12 adjacent the area of the smoke shelf 62 in the firebox 50. A normally closed, bimetal operated, high thermal limited switch 68 is secured to the heated air duct 46 and a normally opened, bimetal operated, thermally responsive fan switch 70 is mounted on the rear wall 38 of the furnace 10. A main motor 72 is connected by wiring to the fan switch 70 and is mechanically linked as by a drive belt to a circulating air blower 74 having its intake opening in the interior of the auxiliary chamber 14 and its output connected to an air port 76 located generally in the firewall 42 in the space between the firebox base 56 and the furnace base 20. Also located in the auxiliary chamber 14 mounted on the auxiliary chamber side wall 34 around the combustion air intake port 48 is a combustion air blower 78 which is also connected by wiring to the limit switch 68. Combustion air tubing 80 extends downwardly from the combustion air blower 78 and then forwardly through the firewall 42 to the forward part of the heating chamber 12 in which it extends upwardly again and then through the firebox side wall 52 into the firebox 50. Also in the auxiliary chamber 14 located at the base of the air intake chamber 40 is a filter 82.

Figure 3:
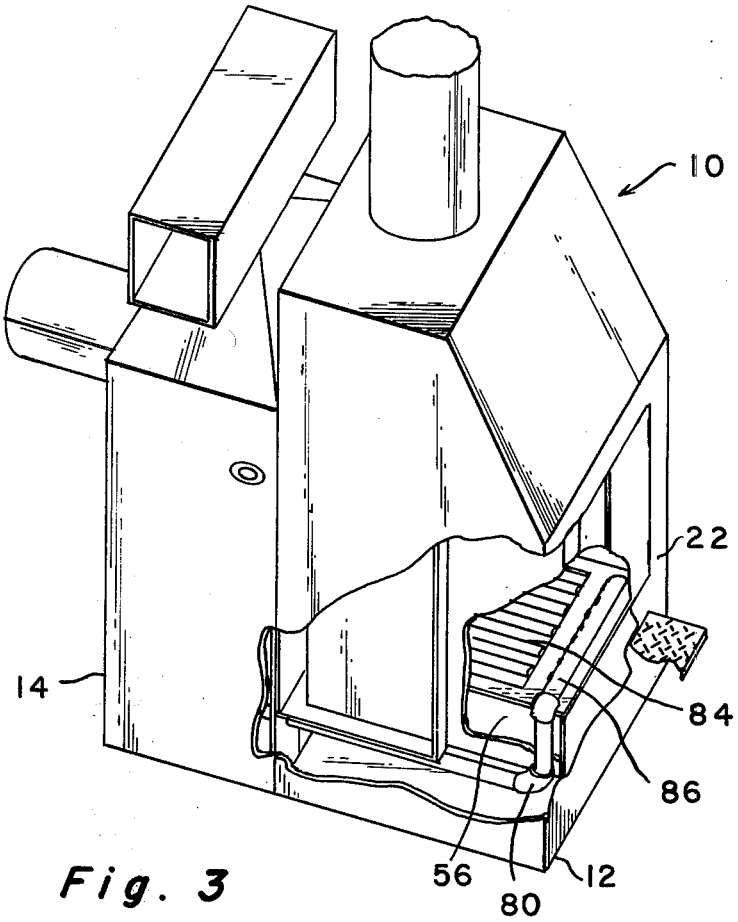
FIG. 3 is a perspective view similar to the furnace of FIG. 1 with a portion of the side wall and a portion of the firebox cut away.

The interior of the firebox 50 can best be seen in FIG. 3 in which a portion of the firebox side wall 52 and the front wall 22 have been removed. A raised grate 84 is provided inside the firebox 50 spaced above the firebox base 56 to support the fire thereon. A combustion air ejection manifold 86 is provided in the forward part of the firebox 50 and is connected to the combustion air tubing 80. A plurality of rearwardly facing holes are formed in the combustion air ejection manifold 86.

Figure 4:
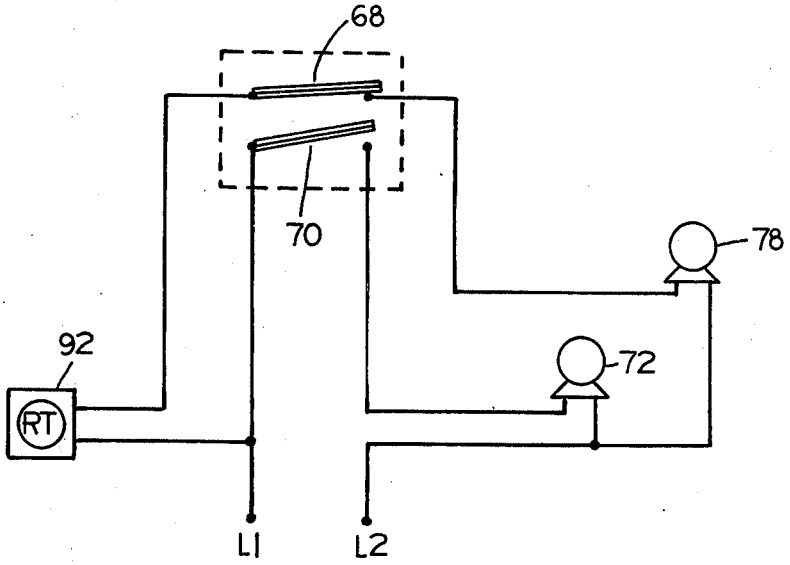
FIG. 4 is a schematic diagram of the control circuit for the furnace of FIG. 1.

The control circuitry for the furnace 10 of FIGS. 1–3 is shown in FIG. 4 with the fan and limit components contained in an assembly represented by a dashed line. The fan switch 70 and the limit switch 68 are electrically connected by suitable wiring to power lines $L_1$ and $L_2$. A room or space thermostat 92 of any conventional structure, such as a spiral bimetal with a temperature setting dial, is wired in series with the limit switch 68 and the combustion air blower 78. The fan switch 70 is wired in series with the circulating air fan 72. It is to be understood that other wiring arrangements may be utilized in accordance with particular installation requirements. For example, the line thermostat 92 may be replaced with a 24 volt thermostat by inserting a step down transformer across the power lines $L_1$ and $L_2$. It should also be understood that many other types of fan and limit switches may be utilized and may be located in a variety of places to conform to installation requirements.

In the operation of the furnace 10 of FIGS. 1–4, the fire is built of wood or coal on the grate 84 in the firebox 50. Access to the fire is through the doors 26 and 28. The hot combustion gases from the fire rise to strike the smoke shelf 62 and then snake between the smoke shelf 62 and the inner canted wall 60 before exiting through the flue stack 32. Thus the firebox 50 and the air surrounding it are heated, with the heat being the most intense in the area around the smoke shelf 62.

The combustion air blower 78 when energized draws air in through the combustion air intake port 48 and forces it under pressure into the combustion air tubing 80. The air passes through the combustion air tubing to the combustion air ejection manifold from which it exits through the rearwardly facing holes in the manifold 86. This combustion air system thus services to inject air directly into the fire to increase the speed and heat of combustion so that the fire supplies more heat during times of heat demand. This feature thus economizes the use of the solid fuel by causing the fire to burn its hottest only when heat demand is required while allowing the fire to subside between times of heat demand to save fuel.

The motor 72 operates the blower 74 to supply the main heated air. The fan 74 draws air from the auxiliary chamber 14 causing a suction which draws air from the air intake duct 44 into the air intake chamber 40 and through the filter 82 into the auxiliary chamber 14. The output air from the fan 74 is forced under pressure into the interior of the heating chamber 12 underneath the firebox 50. This air is channeled by the baffles 64 underneath of the firebox 50, then upwardly along the sides of the firebox and then rearwardly again over the top section of the baffles 64 and 66 on the inner top wall 58. The heated air then is forced downward into the area adjacent the smoke shelf 62 for its final heating before exiting through the heated air duct 46 to be carried to the space to be heated.

The configuration of the firebox 50 and the baffles 64 enable the furnace 10 of FIGS. 1–3 to be particularly efficient in the heating of the intake air. The intake air is exposed to progressively hotter portions of the firebox 50 to ensure that all this air is evenly heated and that it is at its maximum temperature as it leaves the furnace 10. Thus the air port 76 is located underneath the firebox base 56, which, because heat rises, will be the coolest part of the firebox 50. Then the air is directed by the baffles 64 along the front portions of the firebox side walls 52 and 54 which are exposed to the radiant heat of the fire. Then the air is directed over the inner top wall 58 and around the flue stack 32 where the hot combustion gases rise before leaving through the flue stack 32. Finally, the exit for the heated air through the heated air duct 46 is adjacent the smoke shelf 64 which will be the hottest point in the firebox 50 since it is directly over the flames themselves. Thus the heated air leaves at the highest possible temperature, maximizing the efficiency of the furnace 10.

To commence operation of the furnace, the solid fuel, wood, coal, etc., on the furnace grate is ignited by any conventional means, such as a match. With the room thermostat 92 in an unactuated condition, the circuit for the combustion air blower 78 is deenergized; at the same time since there is no heat air in the heated air duct 46, the normally opened fan switch 70 remains open so that the circuit for the circulating air fan is deenergized.

Assuming now there is a demand for heat, the room thermostat 92 closes completing a circuit from power line $L_1$ through the room thermostat 92, the normally closed limit switch 68 and the combustion air blower 78 to the power line $L_2$. Energization of the fan 78 forces auxiliary combustion air through the manifold 86 whereupon the solid fuel on the grate 84 will burn at a high rate.

After a predetermined time period, the furance became heated and the thermally responsive fan switch 70 is closed. Thus, a circuit is completed from the power line $L_1$ through the fan switch 70 and the circulating air blower 74 to the power line $L_2$. Energization of the blower 72 forces heated circulating air out of the heated air duct 46 to the room or space being heated.

When the room is sufficiently heated and the temperature rises to the set temperature of the room thermostat 92, the room thermostat opens causing the combustion air blower 78 to be deenergized whereupon the solid fuel on the grate 84 will only burn at its lower rate. However, the circulating air fan 74 remains energized for a time period as sensed by the thermally responsive fan switch 70. As soon as the heated air is dissipated through the circulation system, the fan switch 70 will sense cool air whereupon the fan switch will open causing deenergization of the circulating air fan 72.

If, for any reason, the temperature in the furnace should exceed a predetermined limit as sensed by the high thermal limit switch 68, this normally closed switch 68 will open causing deenergization of the combustion air blower 78.

Since many modifications, variations, and changes in detail are possible within the scope of the present invention, it is intended that all the material contained in the foregoing description or in the accompanying drawings shall be interpreted as illustrative and not in a limiting sense.

What is claimed is

1. A solid fuel furnace comprising a firebox for containing the fire including two side walls, a rear wall, a firebox base, an inner top wall, and a front wall with an inner canted wall joining the inner top wall to the front wall, a heating chamber surrounding the firebox and including two outer side walls, a rear wall, and a furnace base, the firebox base being spaced above the furnace base, a circulating air fan for forcing air into the heating chamber beneath the firebox base, a heating air duct opening in the rear wall of the heating chamber to allow heated air to leave the heating chamber, a baffle on each side of the firebox, each one connected to both the respective side wall of the firebox and the outer side wall of the heating chamber, the baffles directing air from the blower from underneath the firebox to the top of the firebox and then downwardly along the rear wall of the firebox to enter the heated air duct, and the firebox further including a smoke shelf formed as an indentation in the rear wall of the firebox extending forwardly to form a narrowed region of the firebox between the smoke shelf and the inner canted wall.

2. A solid fuel furnace as claimed in claim 1 wherein the heated air duct opens through the rear wall of the heating chamber at a location adjacent the smoke shelf of the firebox.

3. A solid fuel furnace as claimed in claim 2 wherein there is an auxiliary chamber attached to the heating chamber and separated therefrom by a firewall which forms a front wall of the auxiliary chamber and the rear wall of the heating chamber.

4. A solid fuel furnace as claimed in claim 1 wherein the firebox and the heating chamber both include a single front wall and wherein doors are provided in the front wall to provide access to the firebox.

5. A solid fuel furnace comprising a firebox for containing the fire and including a pair of firebox side walls joined by a firebox base, a firebox rear wall, a front wall, an inner top wall, and an inner canted wall joining the inner top wall to the front wall, a grate in the firebox spaced above the firebox base, a heating chamber surrounding the firebox and formed from a pair of heating jacket side walls joined by a furnace base, a firewall, the front wall, an outer top wall, and an outer canted wall joining the outer top wall to the front wall, a pair of doors opening in the front wall to provide access to the firebox, a smoke flue projecting through the outer top wall and opening through the inner top wall into the firebox, an auxiliary chamber located behind the heating chamber and separated from the heating chamber by the firewall, a smoke shelf formed as an indentation in the firebox rear wall extending forwardly toward the inner canted wall, a heated air duct extending through the auxiliary chamber and opening through the firewall into the heating chamber at a location adjacent the smoke shelf in the firebox, an air intake chamber for admitting air into the auxiliary chamber, a thermally responsive fan delay switch in the furnace, a circulating air fan controlled by the fan delay switch for forcing air from the auxiliary chamber into the heating chamber underneath the firebox base, a combustion air blower and a room thermostat controlling the combustion air blower in accordance with temperature variations sensed by the room thermostat, a high thermal limit switch attached to the heated air duct and connected to operate the combustion air blower if the temperature in the heating chamber exceeds a preselected maximum, a baffle on each side of the firebox, each connected to both a respective firebox side wall and heating jacket side wall, the baffles directing the air from the main blower to the forward part of the firebox then upward along the sides of the firebox to the inner top wall and then downwardly along the rear of the firebox to the heated air duct, a combustion air ejection manifold located inside the firebox, the auxiliary chamber having a combustion air port formed in its side and communicating with the combustion air blower, and combustion air tubing connecting the combustion air blower to the combination air ejection manifold.

* * * * *